US008720122B1

(12) United States Patent
Feldhaus

(10) Patent No.: US 8,720,122 B1
(45) Date of Patent: May 13, 2014

(54) RAIN GUTTER SCREEN ASSEMBLY

(71) Applicant: Phil Feldhaus, Lake Village, IN (US)

(72) Inventor: Phil Feldhaus, Lake Village, IN (US)

( * ) Notice: Subject to any disclaimer, the term of this patent is extended or adjusted under 35 U.S.C. 154(b) by 0 days.

(21) Appl. No.: 14/091,089

(22) Filed: Nov. 26, 2013

Related U.S. Application Data

(63) Continuation-in-part of application No. 13/495,361, filed on Jun. 13, 2012, now Pat. No. 8,595,985.

(60) Provisional application No. 61/496,193, filed on Jun. 13, 2011.

(51) Int. Cl.
*E04D 13/00* (2006.01)
*E04D 13/064* (2006.01)
*E04D 13/072* (2006.01)

(52) U.S. Cl.
CPC ..... *E04D 3/064* (2013.01); *E04D 13/0643* (2013.01); *E04D 13/0725* (2013.01)
USPC ..... 52/12

(58) Field of Classification Search
CPC ... E04D 13/076; E04D 13/064; E04D 13/158; E04D 13/0643; E04D 13/0725; E04D 13/072
USPC ..... 52/11–16; 248/48.1, 48.2
See application file for complete search history.

(56) References Cited

U.S. PATENT DOCUMENTS 453,948 A * 6/1891 Smith et al. ..... 52/12
474,442 A * 5/1892 Byers et al. ..... 210/477
1,308,311 A * 7/1919 Ward ..... 52/12
2,734,467 A * 2/1956 Steele ..... 52/12
3,295,264 A * 1/1967 Olson ..... 52/12
4,907,381 A * 3/1990 Ealer ..... 52/12
4,941,299 A * 7/1990 Sweers ..... 52/12
4,959,932 A * 10/1990 Pfeifer ..... 52/12
4,965,969 A * 10/1990 Antenen ..... 52/12
5,044,581 A * 9/1991 Dressler ..... 248/48.1
5,056,276 A * 10/1991 Nielsen et al. ..... 52/12
5,109,640 A * 5/1992 Creson ..... 52/12
5,271,192 A * 12/1993 Nothum et al. ..... 52/12
5,321,920 A * 6/1994 Sichel ..... 52/12
5,406,754 A * 4/1995 Cosby ..... 52/12
5,555,681 A * 9/1996 Cawthon ..... 52/63
5,611,175 A * 3/1997 Sweers ..... 52/12
5,842,311 A * 12/1998 Morin ..... 52/12
5,848,857 A * 12/1998 Killworth et al. ..... 405/118
6,282,845 B1 * 9/2001 Hines ..... 52/12
6,349,506 B1 * 2/2002 Pace et al. ..... 52/12
6,463,700 B2 * 10/2002 Davis ..... 52/12

(Continued)

*Primary Examiner* — Mark Wendell
*Assistant Examiner* — Keith Minter
(74) *Attorney, Agent, or Firm* — Gene Scott; Patent Law & Venture Group

(57) ABSTRACT

A rain gutter screen assembly is fixed in place over a rain gutter system mounted on a building to prevent the entry of debris into the gutter system. The screen assembly has plural gutter screens with each of the gutter screens having a bead of a water phobic substance engaged on its bottom surface with the bead extending to edges of the screen. The screens are arranged in side-by-side positions such that a bead termination of each one of the beads of each one of the gutter screens is in contact with another bead termination of another one of the beads of another one of the gutter screens so that rain water is unable to bridge the screens but is forced to fall into the gutter system.

15 Claims, 7 Drawing Sheets

(56) References Cited

U.S. PATENT DOCUMENTS

| | | | | |
|---|---|---|---|---|
| 6,735,907 | B2 * | 5/2004 | Stevens | 52/12 |
| 6,932,901 | B2 * | 8/2005 | Crosby | 210/162 |
| 6,951,077 | B1 * | 10/2005 | Higginbotham | 52/12 |
| 7,174,688 | B2 * | 2/2007 | Higginbotham | 52/672 |
| 7,198,714 | B2 * | 4/2007 | Swistun | 210/162 |
| D551,740 | S * | 9/2007 | Riley | D23/267 |
| 7,303,687 | B2 * | 12/2007 | Groth et al. | 52/12 |
| 7,310,912 | B2 * | 12/2007 | Lenney et al. | 52/12 |
| 7,614,185 | B2 * | 11/2009 | Brochu | 52/11 |
| 7,627,991 | B1 * | 12/2009 | Feldhaus | 52/12 |
| 7,793,465 | B2 * | 9/2010 | McCann | 52/12 |
| 8,006,438 | B2 * | 8/2011 | Higginbotham | 52/12 |
| RE42,896 | E * | 11/2011 | Higginbotham | 52/12 |
| 8,069,617 | B2 * | 12/2011 | Wootton | 52/12 |
| 8,312,677 | B2 * | 11/2012 | Higginbotham | 52/12 |
| 2004/0262207 | A1 * | 12/2004 | Crosby | 210/162 |
| 2005/0102909 | A1 * | 5/2005 | Carpenter et al. | 52/11 |
| 2005/0155919 | A1 * | 7/2005 | Swistun | 210/155 |
| 2005/0155920 | A1 * | 7/2005 | Swistun | 210/162 |
| 2006/0053697 | A1 * | 3/2006 | Higginbotham | 52/12 |
| 2006/0070304 | A1 * | 4/2006 | Barnett | 52/11 |
| 2006/0107603 | A1 * | 5/2006 | Brownridge | 52/11 |
| 2006/0117670 | A1 * | 6/2006 | Tsioris | 52/11 |
| 2006/0163129 | A1 * | 7/2006 | Swistun | 210/162 |
| 2006/0179723 | A1 * | 8/2006 | Robins | 52/11 |
| 2006/0201068 | A1 * | 9/2006 | Shane | 52/11 |
| 2006/0230687 | A1 * | 10/2006 | Ealer | 52/12 |
| 2006/0265968 | A1 * | 11/2006 | Lowrie | 52/11 |
| 2007/0107323 | A1 * | 5/2007 | Higginbotham | 52/120 |
| 2007/0204521 | A1 * | 9/2007 | Jackson et al. | 52/11 |
| 2008/0289263 | A1 * | 11/2008 | Brochu | 52/12 |
| 2009/0056234 | A1 * | 3/2009 | Brochu | 52/12 |
| 2009/0107053 | A1 * | 4/2009 | Guilford | 52/12 |
| 2009/0188172 | A1 * | 7/2009 | DuCharme et al. | 52/11 |
| 2009/0300995 | A1 * | 12/2009 | Nikolopoulos | 52/12 |
| 2010/0088971 | A1 * | 4/2010 | Horton | 52/12 |
| 2011/0056145 | A1 * | 3/2011 | Lenney et al. | 52/12 |
| 2011/0067318 | A1 * | 3/2011 | Lenney et al. | 52/12 |
| 2011/0083375 | A1 * | 4/2011 | Tenute | 52/11 |
| 2011/0138697 | A1 * | 6/2011 | Martin | 52/12 |
| 2011/0162289 | A1 * | 7/2011 | Cangialosi | 52/12 |
| 2011/0185641 | A1 * | 8/2011 | Snell | 52/12 |
| 2011/0225898 | A1 * | 9/2011 | Iannelli | 52/12 |
| 2011/0265390 | A1 * | 11/2011 | Brochu | 52/12 |
| 2011/0272344 | A1 * | 11/2011 | Higginbotham | 210/494.1 |
| 2011/0283630 | A1 * | 11/2011 | Beckham et al. | 52/12 |
| 2012/0047817 | A1 * | 3/2012 | Prentice | 52/11 |
| 2012/0159868 | A1 * | 6/2012 | Lenney et al. | 52/12 |

* cited by examiner

RAIN GUTTER SCREEN ASSEMBLY

In full or in part, this application describes the same apparatus and method as presented in co-pending non-provisional application Ser. No. 13/495,361, filed on Jun. 13, 2012, and claims international date priority thereof as a Continuation-In-Part application. The subject matter of application Ser. No. 13/495,361 is hereby incorporated herein by reference in its entirety.

BACKGROUND

The present disclosure relates to rain gutter screens which are normally fixed in place over rain gutters to prevent the entry of debris such as: leaves, twigs, branches, flowers, seed pods, and other objects into the gutters. This disclosure relates to such assemblies and particularly assemblies that have a means for preventing roof runoff water from flowing across the screens. This disclosure relates also to assemblies of such covers and to the structure and use of such assemblies which may be used where roof portions meet at an inside right angle or other acute angle. Such roof portions tend to have a large water flow centered on the seam where the two roof sections meet. This is a serious problem since fast moving runoff tends to leap across standard rain gutters. Previously, no satisfactory solution to this problem has been available. The presently described apparatus solves this problem as will be clearly described in this writing and shown in the associated drawing figures.

BRIEF DESCRIPTION OF THE DRAWINGS

Like reference symbols in the drawing figures indicate like elements.

DETAILED DESCRIPTION

Figure 1:
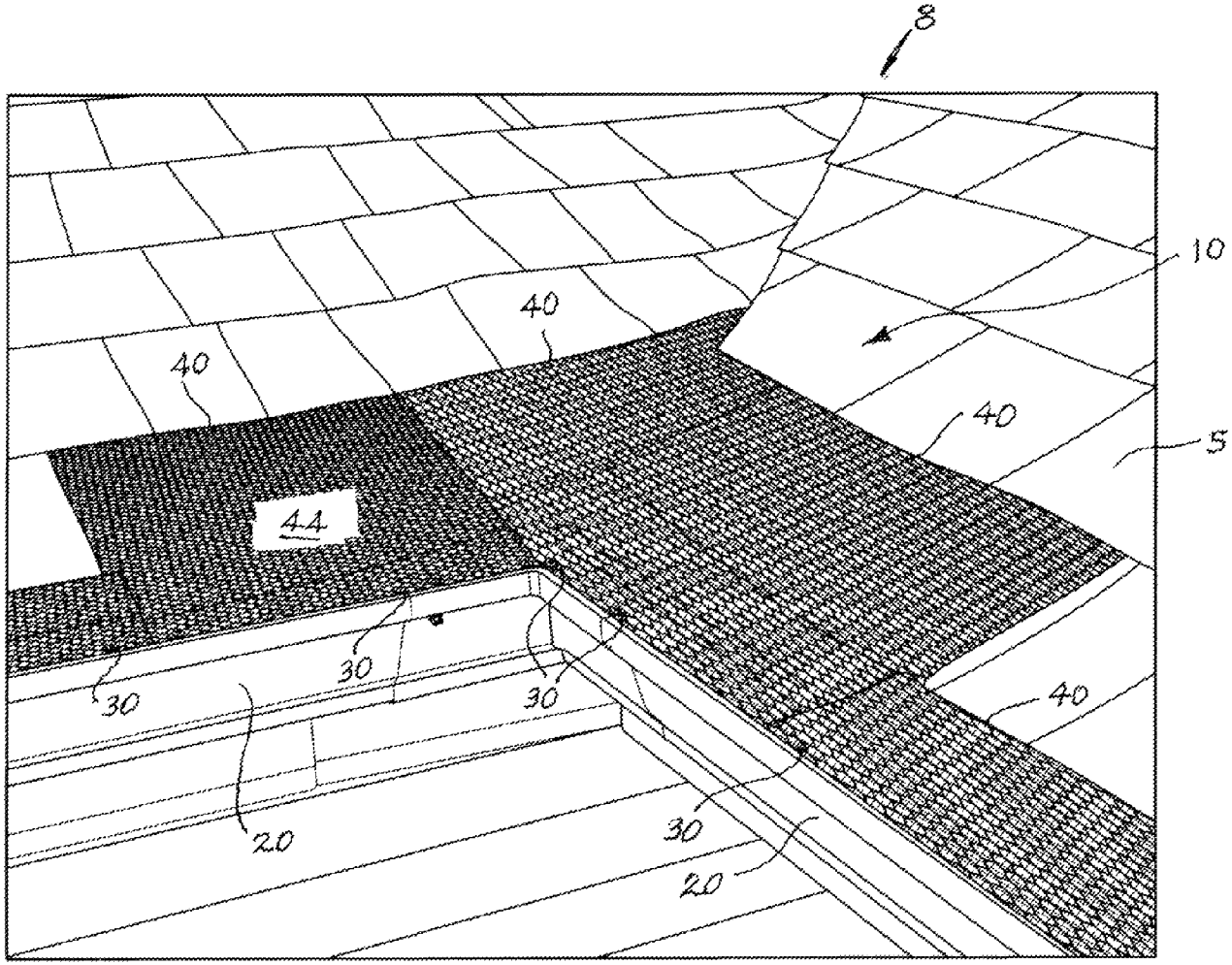
FIG. 1 is an example perspective view of a first screen assembly as mounted over rain gutters having an inside right angle.
Figure 2:
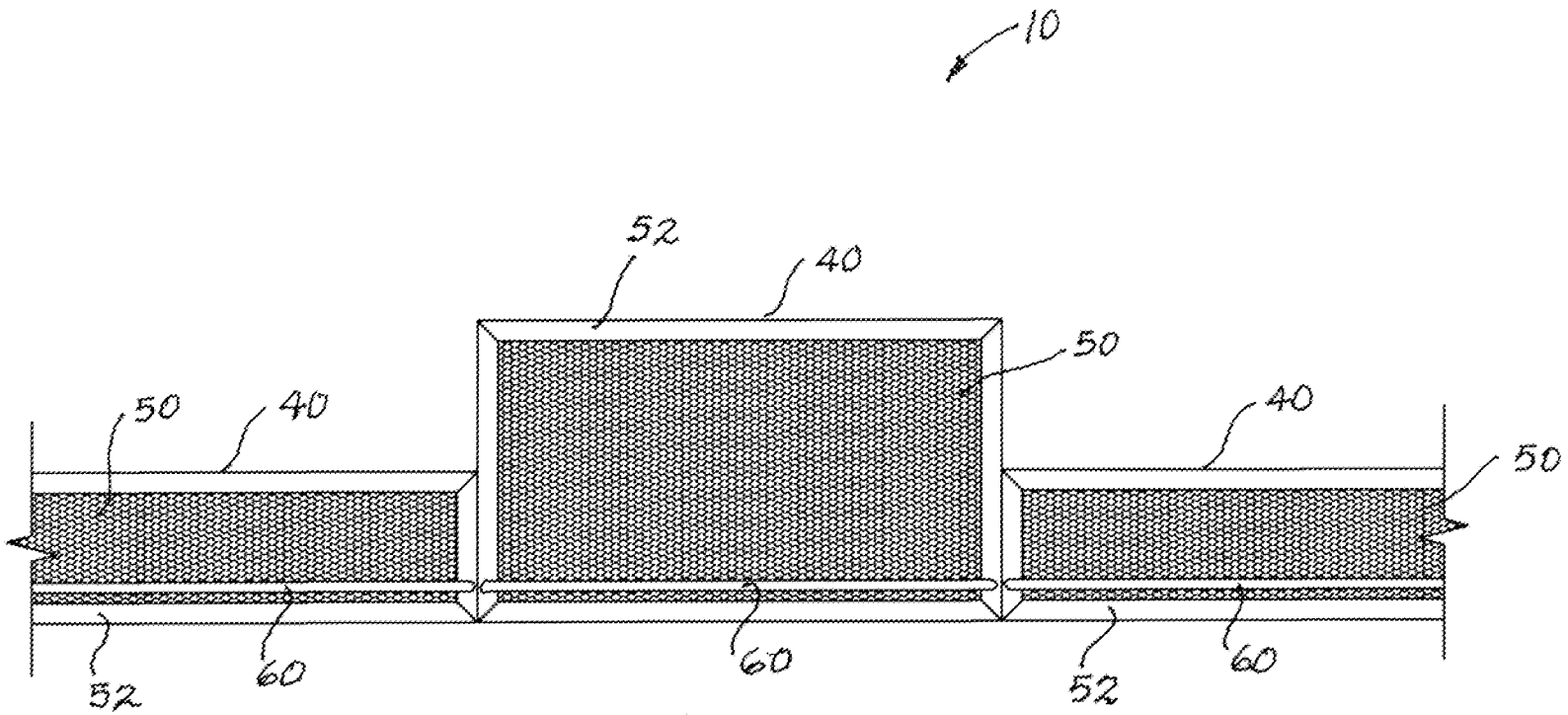
FIG. 2 is an example of a bottom plan view of a second cover assembly.
Figure 3:
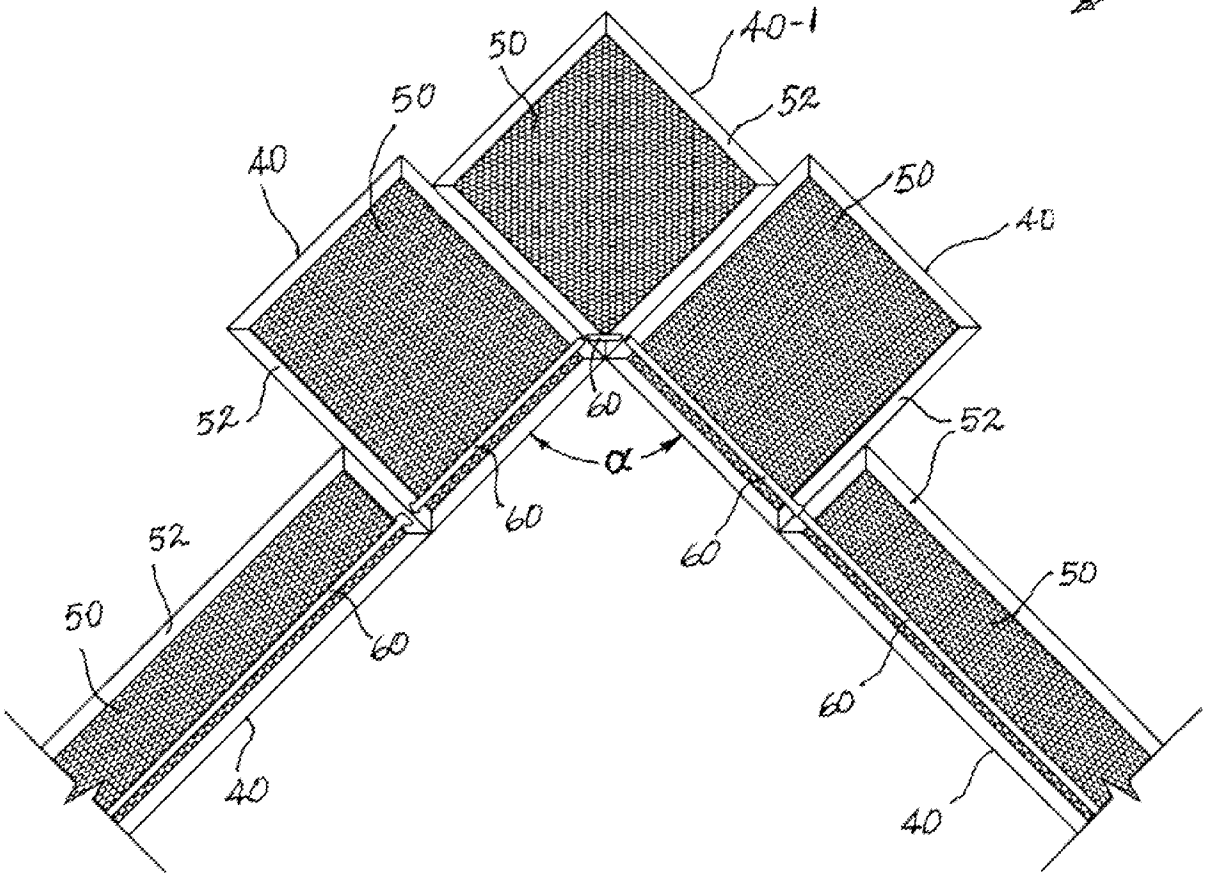
FIG. 3 is an example of a bottom plan view of a third cover assembly.
Figure 4:
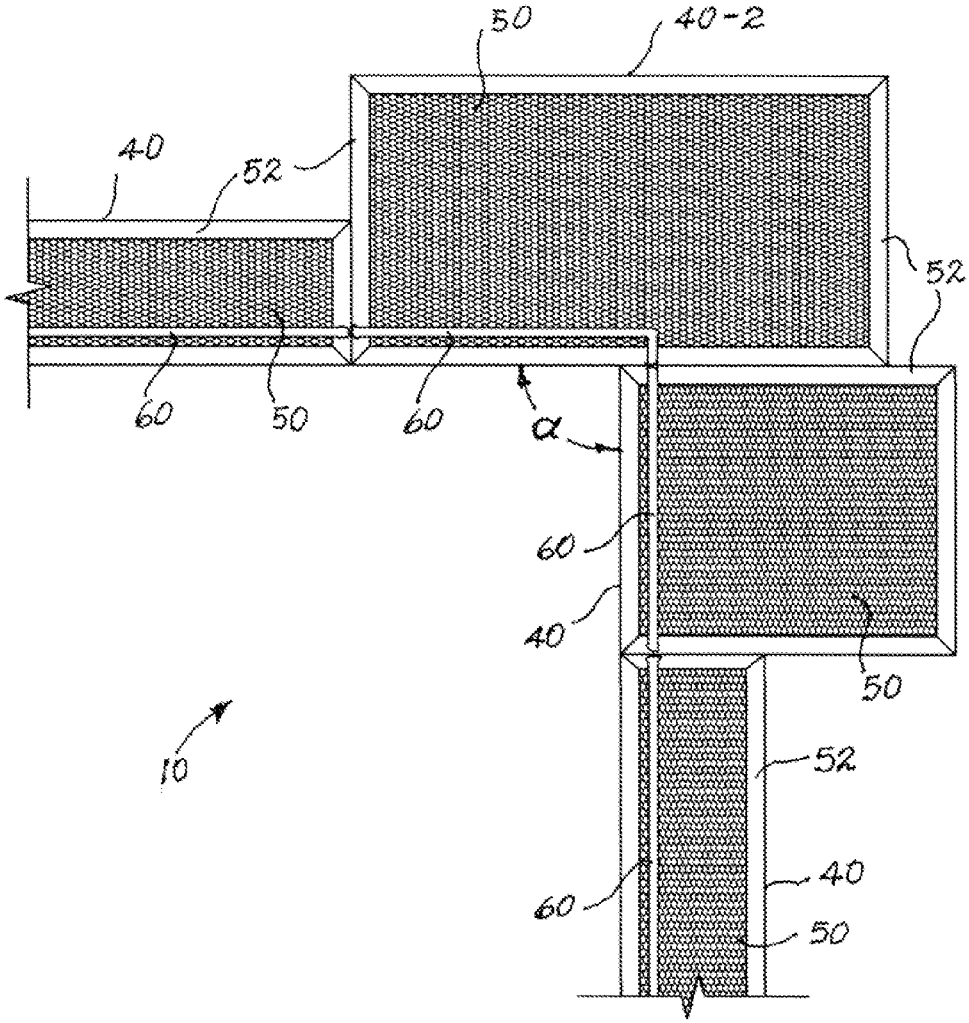
FIG. 4 is an example of a bottom plan view of a fourth cover assembly.
Figure 5:
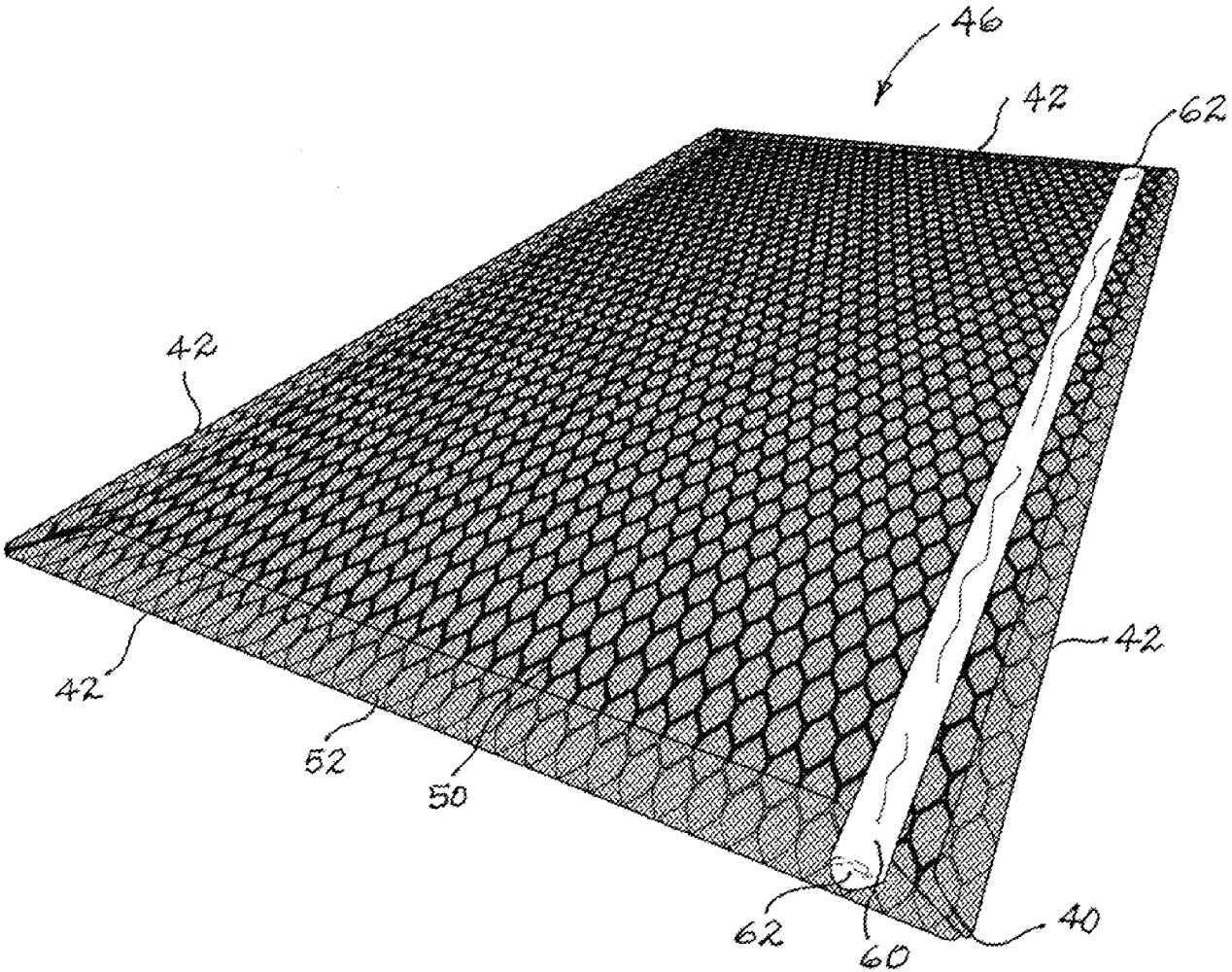
FIG. 5 is an example bottom perspective view of a single cover.
Figure 6:
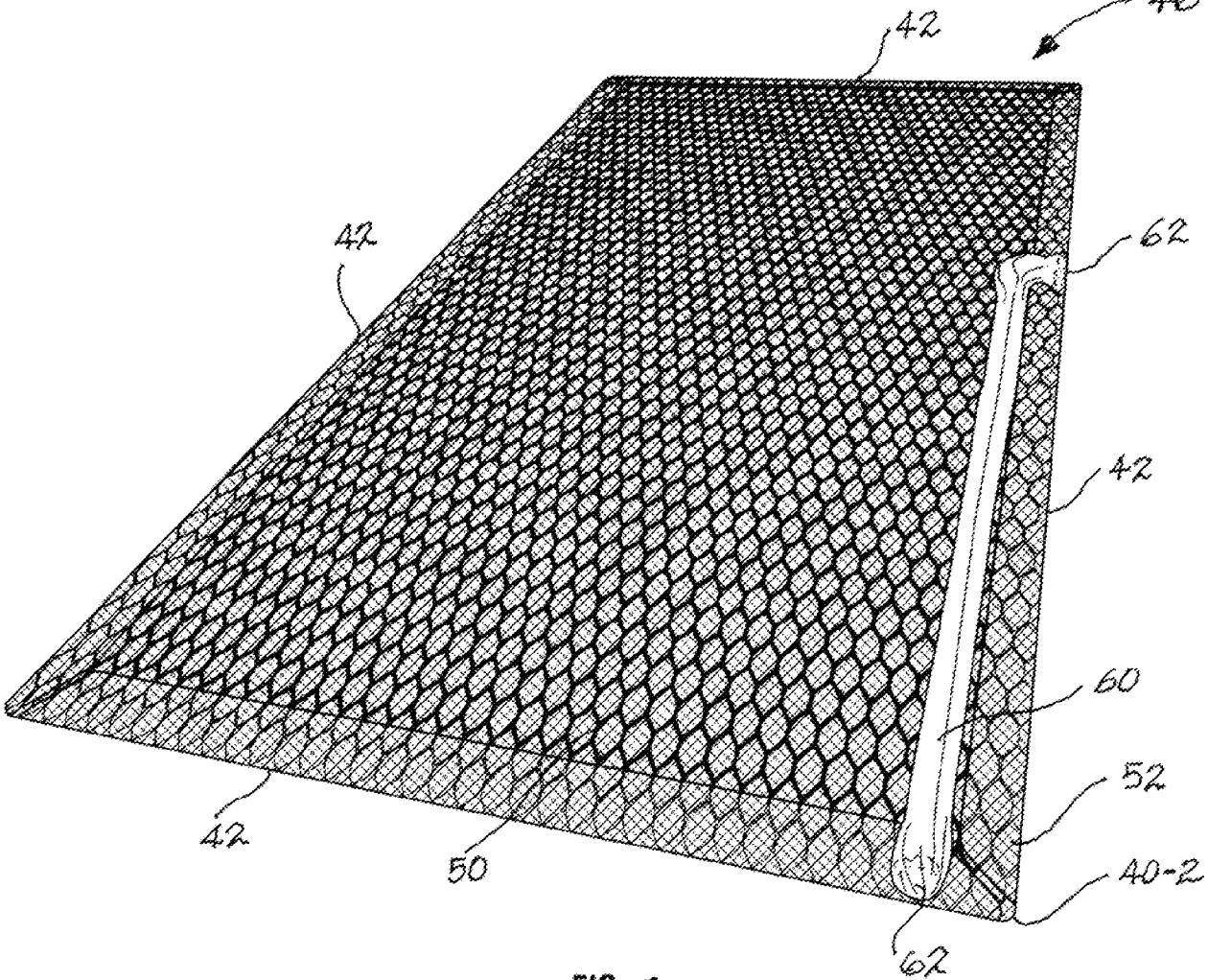
FIG. 6 is an example bottom perspective view of a further single cover.
Figure 7:
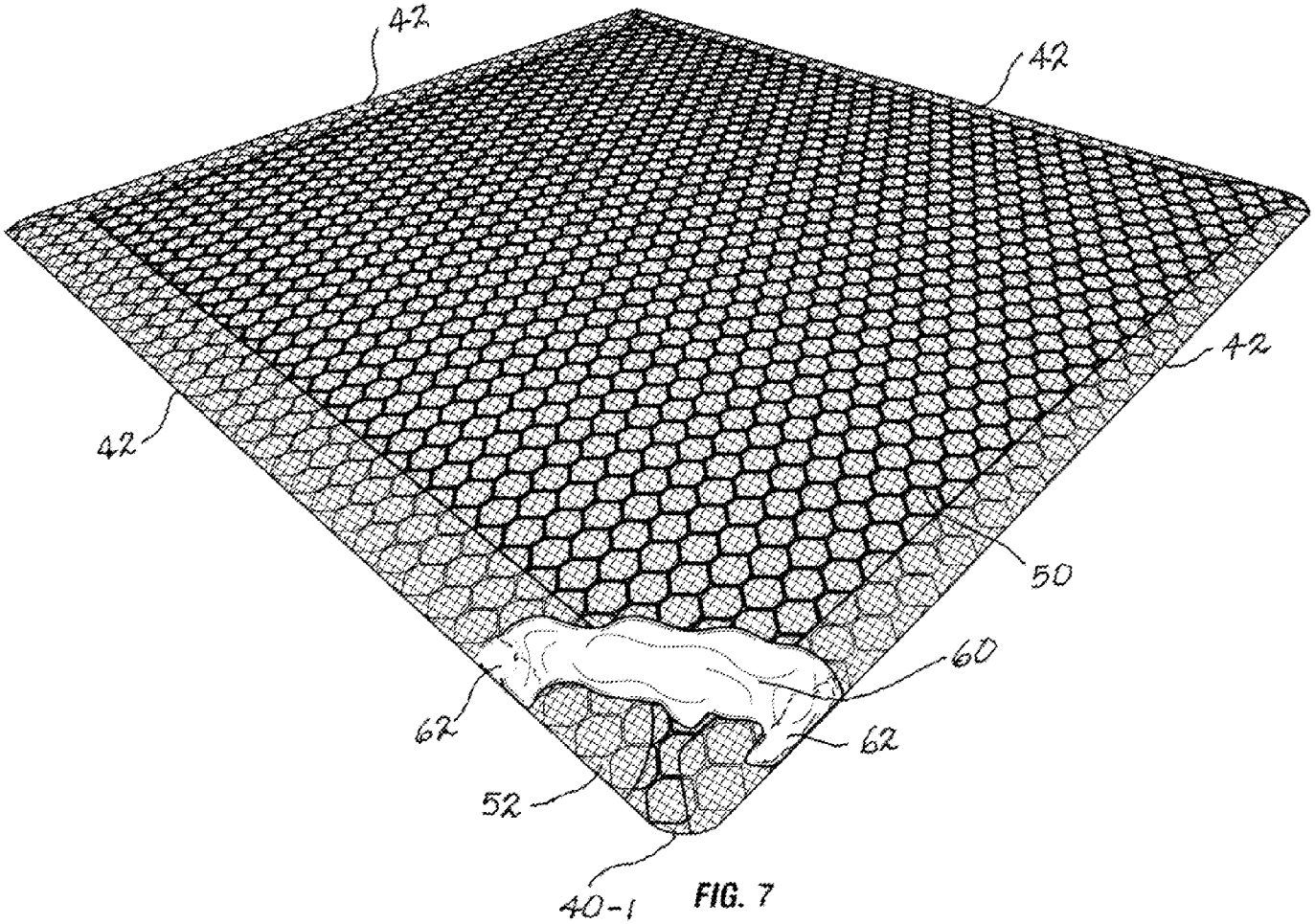
FIG. 7 is an example bottom perspective view of a still further single cover.

The presently described apparatus is a screen assembly 10 which protects a rain gutter system 20 from debris such as leaves and twigs. FIG. 1 shows an embodiment of assembly 10 as mounted to a system 20. The method of mounting may include driving screws 30 through assembly 10 into system 20, and may also include wedging portions of assembly 10 under elements of roofing 5 of a peaked roof as depicted. The assembly 10 may be made up of a plurality of gutter screens 49 (FIGS. 2-4) wherein each one the screens 49 has edges 42, a top surface 44 (FIG. 1), and a bottom surface 46, as shown in FIGS. 5-7. Screens 49 may be rectangular as shown in the figures or may have other geometrical shapes, such as triangular, hexagonal, and circular in order to cover systems 20 of various configurations. Such other screens and systems are not shown in this disclosure but would be enabled by those of skill with the knowledge gained in this disclosure. As shown in FIGS. 5-7, the screens 49 are essentially planar and flat, but may be slightly non-planar or curved, as shown in FIG. 1 in order to extend onto a peaked roof. As shown in FIGS. 2-4, the several screens 49 that make up an assembly 10 may have different sizes and shapes. In order to collect larger quantities of fast moving rain runoff centered along roof intersections such as shown by arrow 8 in FIG. 1, larger gutters and larger gutter screens are needed. The screen assemblies 10 described herein have been found to be effective as a solution to this problem.

As illustrated in FIGS. 5-7 a screen 49 of the type that is used as a component of the screen assemblies 10 may be constructed using an expanded metal sheet 50 for rigidity, and sheet 50 may be covered by a fine mesh screening 52 which forms the top surface 44 of screen 49. Screening 52 may be folded around sheet 50 forming the edges 42 thereby also forming a part of bottom surface 46 as shown. Screen 49 may have a bead 60, of a hydrophobic substance, engaged with the bottom surface 46, the bead 60 terminating at its ends at bead terminations 62 wherein each one of the terminations 62 is positioned at one of the edges 42. Bead 60 has a cross-section that is roughly circular and at least one-half inch in diameter. Since bead 60 extends downwardly from the bottom surface 46, water moving across surface 46 by surface tension adhesion on the structural elements of screen 49, when encountering the hydrophobic surface of bead 60 loses surface tension adhesion and drops away from bead 60 into the gutter system 20.

As shown in FIG. 2, an assembly 10 may include at least three screens 49 positioned in a linear arrangement with each of the screens 49 abutting at least one further of the screens 49, and as shown at least one of the screens 49 may be wider than at least one other of the screens 49 in order to accommodate variations in roof structures and gutter systems 20.

As shown in FIG. 3, assembly 10 may include at least five screens 49 positioned in an arrangement having an acute angle $\alpha$ with each of the screens 49 abutting at least one further screen 49. In this arrangement one screen 49-1 has a bead 60 positioned diagonally across a corner of the screen 49-1.

As shown in FIG. 4 assembly 10 may include at least four screens 49 positioned in an arrangement having an acute angle $\alpha$ with each of the screens 49 abutting at least one further screen 49. In this arrangement a screen 49-2 has a bead 60 with two legs joined at an acute angle $\alpha$. The screens 49 in this arrangement are in side-by-side positions such that a bead termination 62 of each one of the beads 60 of each one of the screens 49 is in contact with another bead termination 62 of another one of the beads 60 of another one of the screens 49.

The hydrophobic material may have components including at least one of alkane, oil, fat, grease, silicone, rubber, and fluorocarbon. Therefore, beads 60 resist water flow over its surface so that water attempting to bridge over screens 49 merely drops into the gutter system when contacting beads 60. In that bead terminations 62 are at screen edges 42 provides for a continuous barrier to water bridging screens 49.

Embodiments of the subject apparatus and methods have been described herein. Nevertheless, it will be understood that modifications by those of skill in the art may be made without departing from the spirit and understanding of this disclosure. Accordingly, other embodiments and approaches are within the scope of the following claims.

What is claimed is:

1. A rain gutter screen assembly, the assembly comprising:

plural gutter screens, each one of the gutter screens having an edge and a surface;

each of the gutter screens further having a bead of a hydrophobic substance engaged with and extending below, the surface, the bead having a bead termination at the edge; and the plural gutter screens arranged in side-by-side positions such that a bead termination of each one of the beads of each one of the gutter screens is in contact with another bead termination of another one of the beads of another one of the gutter screens.

2. The assembly of claim 1 wherein the plural gutter screens include at least three gutter screens positioned in a linear arrangement with each of the gutter screens abutting at least one further of the gutter screens.

3. The assembly of claim 2 wherein at least one of the gutter screens is wider than at least one other of the gutter screens.

4. The assembly of claim 1 wherein the plural gutter screens include at least five gutter screens positioned in an arrangement having an acute angle with each of the gutter screens abutting at least one further of the gutter screens.

5. The assembly of claim 4 wherein the bead of one of the at least five gutter screens is positioned diagonally across a corner of the one of the gutter screens.

6. The assembly of claim 1 wherein the plural gutter screens include at least four gutter screens positioned in an arrangement having an acute angle with each of the gutter screens abutting at least one further of the gutter screens.

7. The assembly of claim 6 wherein the bead of one of the at least four gutter screens has a pair of bead legs, the bead legs joined at an acute angle.

8. A rain gutter screen assembly for use in a gutter system location wherein two roof portions meet at an acute angle, the assembly comprising:

plural gutter screens, each one of the gutter screens having an edge and a surface;

each of the gutter screens further having a bead of a hydrophobic substance engaged with and extending below, the surface, the bead having a bead termination positioned at the edge; and the plural gutter screens arranged in side-by-side positions such that a bead termination of each one of the beads of each one of the gutter screens is in contact with another bead termination of another one of the beads of another one of the gutter screens.

9. The assembly of claim 8 wherein the plural gutter screens include at least three gutter screens positioned in a linear arrangement with each of the gutter screens abutting at least one further of the gutter screens.

10. The assembly of claim 9 wherein at least one of the gutter screens is wider than at least one other of the gutter screens.

11. The assembly of claim 8 wherein the plural gutter screens include at least five gutter screens positioned in an arrangement having the acute angle with each of the gutter screens abutting at least one further of the gutter screens.

12. The assembly of claim 11 wherein the bead of one of the at least five gutter screens is positioned diagonally across a corner of the one of the gutter screens.

13. The assembly of claim 11 wherein the plural gutter screens include at least four gutter screens positioned in an arrangement having the acute angle with each of the gutter screens abutting at least one further of the gutter screens.

14. The assembly of claim 13 wherein the bead of one of the at least four gutter screens has a pair of bead legs, the bead legs joined at an acute angle.

15. A rain gutter screen assembly for use in a gutter system location wherein two roof portions meet at an acute angle, the assembly comprising:

plural gutter screens, each one of the gutter screens having an edge and a surface;

each of the gutter screens further having a bead of a hydrophobic substance engaged with and extending below, the surface, the bead having a bead termination positioned at the edge;

the plural gutter screens arranged in side-by-side positions such that a bead termination of each one of the beads of each one of the gutter screens is in contact with another bead termination of another one of the beads of another one of the gutter screens; and wherein at least one of the plural gutter screens is adjacent to the acute angle, the at least one said gutter screen having a larger surface area than at least one other of the gutter screens.

* * * * *